US005590795A

United States Patent [19]

Wright

[11] Patent Number: 5,590,795

[45] Date of Patent: Jan. 7, 1997

[54] SADDLE HOLDER

[76] Inventor: Jeffrey M. Wright, 23529 Pocahontas Dr., Gaithersburg, Md. 20882

[21] Appl. No.: 492,225

[22] Filed: Jun. 19, 1995

[51] Int. Cl.[6] ..... A47F 7/00

[52] U.S. Cl. ..... 211/104; 211/13; 211/86

[58] Field of Search ..... 211/13, 86, 87, 211/104; 248/214

[56] References Cited

U.S. PATENT DOCUMENTS

| | | | |
|---|---|---|---|
| 1,996,552 | 4/1935 | Schwender | 211/87 |
| 2,577,397 | 12/1951 | Bailey | 211/104 X |
| 2,740,532 | 4/1956 | Kleinsmith | 211/104 |
| 2,952,366 | 9/1960 | Botten | 211/104 |
| 3,233,745 | 2/1966 | Hershberger | 211/104 |
| 3,688,912 | 9/1972 | Wilmoth | 211/13 |
| 3,780,971 | 12/1973 | De Filipps | 211/104 X |
| 4,356,922 | 11/1982 | Dierksheide | 211/104 X |
| 5,054,628 | 10/1991 | Allen | 211/104 |

*Primary Examiner*—Robert W. Gibson, Jr.
*Attorney, Agent, or Firm*—Michael W. York

[57] ABSTRACT

A saddle holder that is portable that has the capability of being collapsed to enhance its portability. The saddle holder has a saddle support frame plus two other members that are rotatably connected to the saddle support frame and one of these has a hook member for providing the structure to connect the saddle holder and support from a structure that is external to the saddle holder. The rotatable members also allow the saddle holder to be connected to and supported from a structure external to the saddle holder through a clamping like action when the hook member is not in use and this is adjustable to conform to surfaces that have different contours. Adjustable bracing members are also provided that are associated with the rotatable members that serve to provide for the connection of the saddle holder and its support from an external structure.

10 Claims, 4 Drawing Sheets

SADDLE HOLDER

BACKGROUND OF THE INVENTION

High quality saddles for horses are expensive and their proper care is needed to maintain the saddle in condition in order to prevent its condition, quality and value from being diminished. An important part of maintaining the condition of a saddle is to ensure that it is properly stored. Typically, the proper storage of a saddle means that it is stored or placed on a saddle holder that is commonly located in the stable. Commonly, the saddle holder includes a fixed projection that extends substantially horizontally from a wall or the like. The saddle is then placed upon this projection when it is not in use. This allows the saddle to maintain its proper shape which would not be maintained if it were allowed to merely rest on the floor or the like. The usual fixed saddle holder that is located in a stable or barn or the like is fine. However, saddles are commonly used and required to be stored at locations where such fixed saddle holders are not available. An example of such a use and need for storage is in connection with horse shows.

There is a definite need to properly store a saddle while traveling and away from a stable. There are a few removable saddle holders. Examples of such saddle holders are set forth in U.S. Pat. Nos. 2,740,532; 2,952,366; 3,233,745; 3,780,971; 3,780,971 and U.S. Pat. No. 4,356,922. Unfortunately, such removable saddle holders do not meet the needs involved in travelling with a saddle. In this connection, it is possible that a saddle holder may need to be used on a vehicle and also in a hotel room or the like. However, existing saddle holders do not have the flexibility to satisfy such requirements. For instance, they may not be readily adaptable to fit or be attached to a vehicle as well as in a hotel room. In addition, the configuration or shape of vehicles may vary considerably and this problem is not addressed with prior art saddle holders.

This saddle holder invention overcomes these problems associated with such prior art saddle holders and provides a portable saddle holder that has a plurality of attachment provisions that permit it to be attached to various portions of vehicles as well as in a hotel room such as on a door or the like. The portable saddle support is also adjustable to accommodate various vehicle configurations. The saddle holder is also easily collapsible to allow it to be readily transported.

SUMMARY OF THE INVENTION

This invention relates to saddle holders and more particularly to portable saddle holders.

Accordingly it is an object of the invention to provide a saddle holder that is readily portable.

It is an object of the invention to provide a portable saddle holder that is easy to use.

It is an object of the invention to provide a portable saddle holder that is adapted for use at a variety of locations.

It is an object of the invention to provide a portable saddle holder that is adapted to be connected adjacent to a variety of different surfaces.

It is an object of the invention to provide a portable saddle holder that is adapted to be connected adjacent to both flat and curved surfaces.

It is an object of the invention to provide a portable saddle holder that is adjustable to conform to various surfaces.

It is an object of the Invention to provide a portable saddle holder that is adjustable to conform to changes in the contours of various surfaces.

It is an object of the invention to provide a portable saddle holder that is adjustable to conform to three dimensional changes in the contours of various surfaces.

It is an object of the invention to provide a portable saddle holder that provides good support for the saddle when it is in its in use position.

It is an object of the invention to provide a portable saddle holder in which a portion of the saddle holder can serve a dual function.

It is an object of the invention to provide a portable saddle holder in which a portion of the saddle holder can serve as means to connect the holder or means to support the holder.

It is an object of the invention to provide a portable saddle holder which has anti-binding provisions to prevent it from binding when it is in its in use position or being moved into its in use position.

It is an object of the invention to provide a portable saddle holder which has protective means for preventing marring of the surface to which it is to be attached and rest upon for support.

It is an object of the invention to provide a portable saddle holder which has a protective plastic coating that covers at least a portion of its surface.

It is an object of the invention to provide a portable saddle holder which has a high strength to weight ratio.

It is an object of the invention to provide a portable saddle holder which is easy to transport.

It is an object of the invention to provide a portable saddle holder which is light in weight.

It is an object of the invention to provide a portable saddle holder which is easy to store when not in use.

It is an object of the invention to provide a portable saddle holder which is collapsible into a compact thin package.

It is an object of the invention to provide a portable saddle holder which is easy to collapse.

It is an object of the invention to provide a portable saddle holder which is easy to extend from its collapsed configuration or position to its in use configuration or position.

It is an object of the invention to provide a portable saddle holder which is easy to manufacture.

It is an object of the invention to provide a portable saddle holder which is inexpensive to manufacture.

It is an object of the invention to provide a portable saddle holder which requires no special equipment to manufacture.

These and other objects of the invention will be apparent from the following description of the portable saddle holder invention that includes a saddle support frame and connecting means for connecting the portable saddle holder to support structure that is external to the portable saddle holder. The connecting means comprises means for connecting the portable saddle holder in two different ways to external support structures. One of these includes a hook member and the other includes adjustable clamping means with adjustable jaw members. These adjustable jaw members also can serve the dual function of being support means for providing for additional support for the saddle support frame when the other connecting means that has the hook member is in use. The connecting means are pivotally connected to the saddle support frame to allow the connecting means to be adjustable and also to allow the portable saddle holder to be collapsed when it is not in use.

BRIEF DESCRIPTION OF THE DRAWINGS

The invention will be hereinafter more fully described with references to the accompanying drawings in which.

DESCRIPTION OF THE PREFERRED EMBODIMENT

Figures 1, 2:
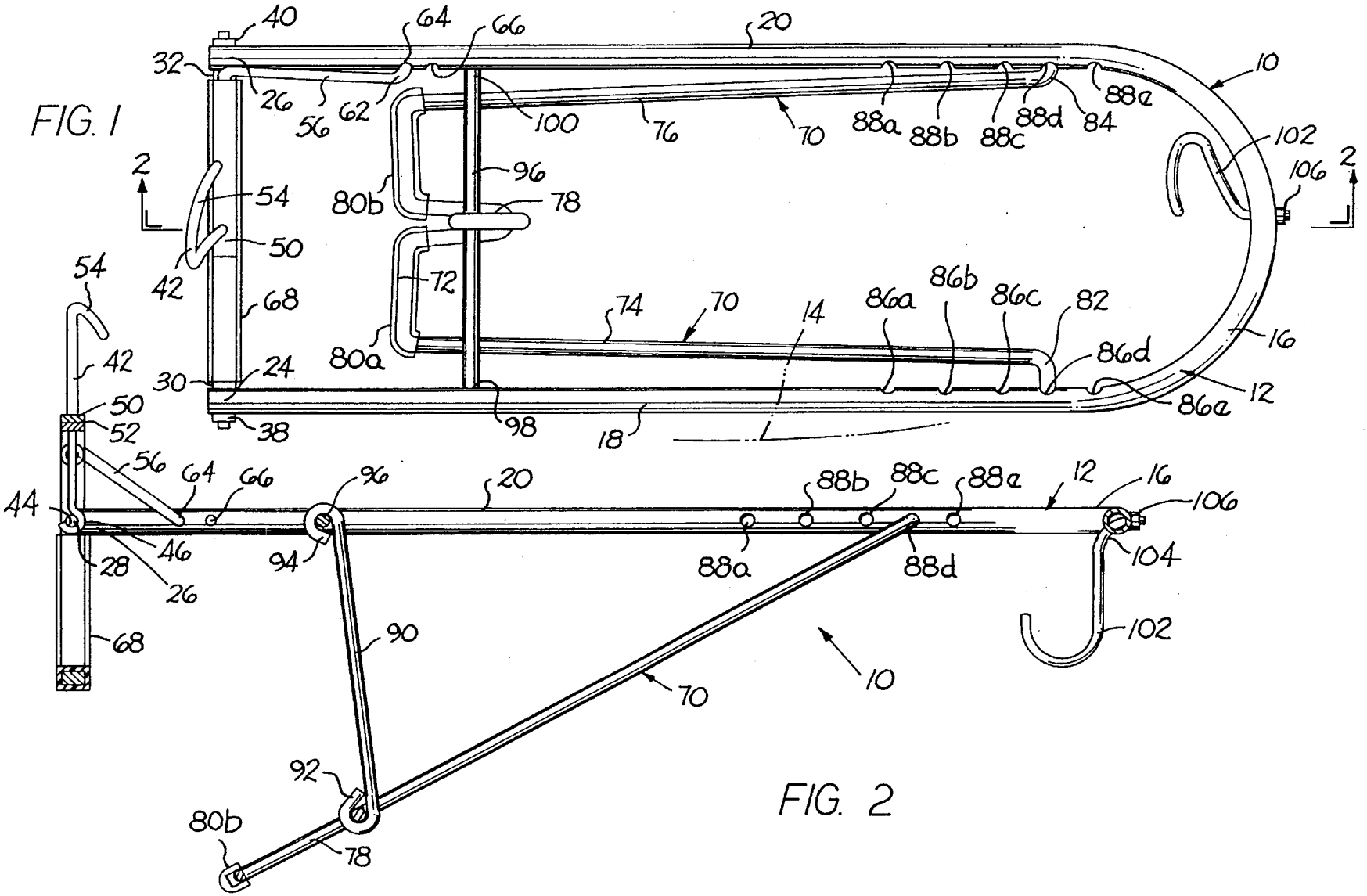
FIG. 1 is a top plan view of the portable saddle holder invention in its noncollapsed or in use or extended position.
FIG. 2 is a sectional view taken substantially on the line 2—2 of FIG. 1.
Figure 4:
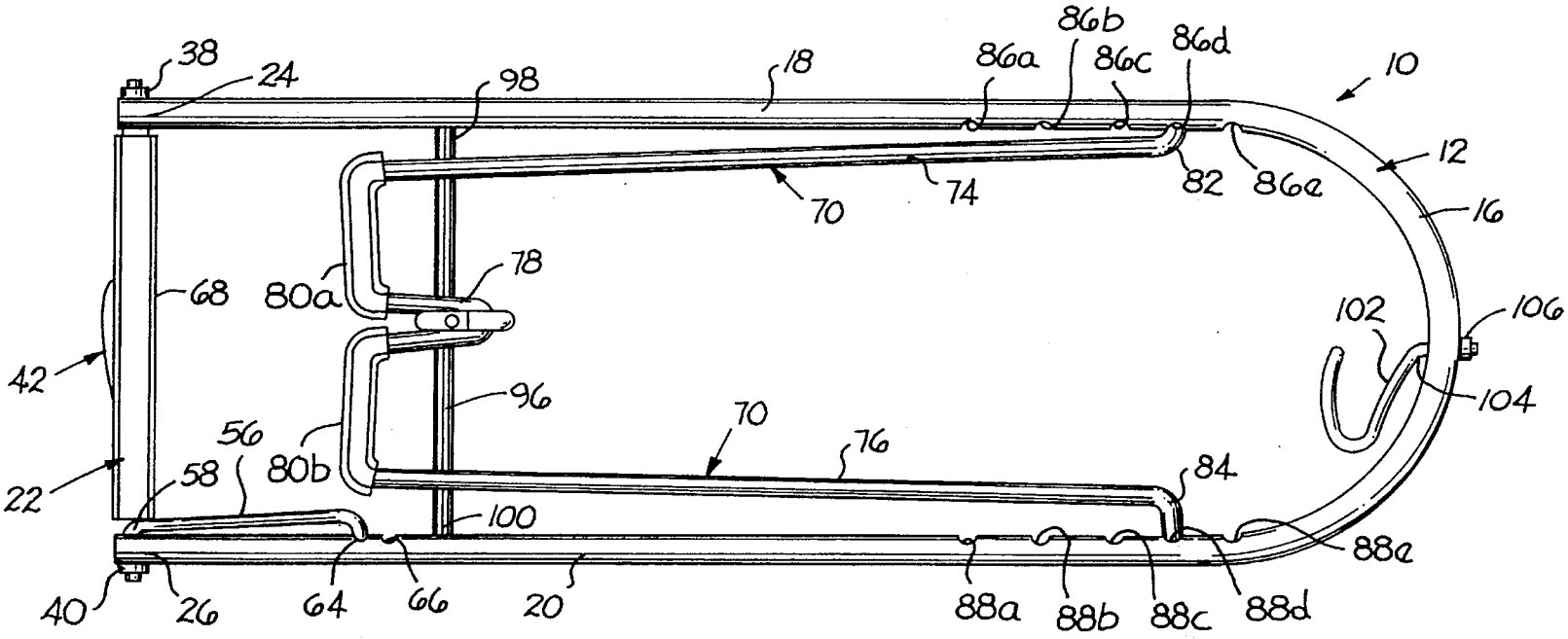
FIG. 4 is a bottom plan view of the portable saddle holder set forth in FIGS. 1 through 3 in its in use position.

Referring first to FIGS. 1 through 6, the portable saddle holder invention is illustrated and is designated generally by the number 10 and comprises a saddle support frame 12 that contacts and supports a saddle shown in phantom in FIG. 1 and is designated by the number 14 when the portable saddle holder 10 is in use. The saddle support frame 12 comprises a single hollow tubular member with an outer semicircular curved portion 16 and two connected identical straight portions 18 and 20 that extend from the curved portion 16.

The portable saddle holder 10 also comprises a generally rectangular shaped open frame structure 22 that is pivotally connected to the outer end portions 24 and 26 of the respective straight portions 18 and 20 of the saddle support frame 12 by a pivot member 28 whose respective outer end portions 30 and 32 pass through respective holes in the central portions 34 and 36 of the frame structure 22 and holes in the adjacent outer end portions 24 and 26 of the saddle support frame 12. The pivot member 28 is secured in place by respective end cap members 38 and 40 that are connected to the respective outer end portions 30 and 32 of the pivot member 28.

The pivot member 28 also serves the additional purpose of securing a hook member 42 in place since a portion of the pivot member 28 passed through an aperture 44 in the eyelet portion 46 of the hook member 42.

It should be noted that the hook member 42 also has a substantially straight shaft portion 48 that is connected to the eyelet portion 46 and whose upper end portion passes through holes in the end portions 50 and 52 of the frame structure 22 to secure these end portions 50 and 52 together. The upper end of the hook member 42 has a curved or hook shaped portion 54 that can be located around an object such as a doorknob that is located exterior to the saddle holder 10. The rotatable frame structure 22 can be secured in place in its in use position through the use of a rotatably connected elongated brace member 56 that has an end portion 58 rotatably secured in a hole in the frame structure 22 and the end portion 58 is held in place by an end cap 60. The other end portion 62 is sized and shaped to be inserted into either the hole 64 or 66 located in the straight portion 20 of the saddle support frame 12. This permits the frame structure 22 and associated hook member 42 to be secured in place in a desired angular relationship with the long axis of the saddle support frame 12. It should also be noted that the lower portion of the frame structure 22 is covered or surrounded by a plastic coating or a plastic tube 68 that prevents damage to the surface of an exterior object that is located adjacent to the lower portion of the frame structure 22 when the saddle holder 10 is in use.

The saddle holder 10 also comprises a combined clamping and support frame 70 that is generally U-shaped with a base portion 72 and two projecting leg portions 74 and 76. The base portion 72 has an inward projecting projection 78 and it will be noted that base portion 72 has a portion thereof that is covered by plastic tubing or a coating 80*a* and 80*b*. The outer end portions of the projecting leg portions 74 and 76 have respective outward extending projections 82 and 84 that are sized and shaped to fit into one of the respective holes 86*a*, 86*b*, 86*c*, 86*d*, 86*e*, and 86*f* and 88*a*, 88*b*, 88*c*, 88*d*, 88*e*, or 88*f* of the respective straight portions 18 and 20 of the saddle support frame 12.

The clamping and support frame 70 is connected to the saddle support frame 12 by a connecting bar member 90 that has an outer end portion 92 that is rotatably connected to the depression 78 by being twisted around the inner portion of the projection 78 and the other end portion 94 of the connecting bar member 90 is also rotatably connected to a substantially straight cross bar member 96 by the end portion 94 being twisted around the central portion of the cross bar member 96. The respective outer end portions 98 and 100 of the cross bar member 96 are rigidly secured to the inner portions of the respective straight portions 18 and 20 of the saddle support frame 12 by means known in the art such as by welding or the like. Another hook member 102 is rotatably connected to the central portion 16 of the saddle support frame 12 by means of a projection 104 on the hook member 102 that is rotatably located in a hole in the central portion 16. The hook member 102 is secured in place by a securing cap member 106 that is fastened on the outer end of the projection 104. This hook member 102 can be used to hook or store a bridle or the like.

The saddle holder 10 is manufactured in the following manner. The saddle support frame 12 is manufactured from suitable high grade aluminum or steel tubing known in the art, with aluminum tubing being preferred, through bending, cutting and drilling techniques known in the art. The clamping and support frame 70 is manufactured from a suitable high grade steel circular cross sectional wire and the open frame structure 22 is manufactured from suitable high grade rectangular cross sectional steel bar stock through the use of cutting, bending and drilling techniques known in the art. The hook members and 102 and the connecting bar member 90 as well as the connecting bar member are all manufactured from suitable high grade circular cross sectional steel wire using known cutting and bending techniques where required. The cross bar member 96 is manufactured from circular cross sectional high grade steel or aluminum rod. The protective coverings 68, 80*a* and 80*b* are cut from high grade plastic tubing known in the art and the various fasteners are standard off the shelf items.

The assembly of the saddle holder 10 is essentially straight forward and should be obvious to one skilled in the art. The open frame structure 22 is assembled by first sliding the plastic tubing 68 into place around its lower portion of the frame structure 22. The two end portions and 50 and 52 are then pulled together and the hook member 42 portion is inserted through the holes in the two end portions 50 and 52. Then the frame structure 22 is pivotally connected to the inner end portion of the saddle support frame 12 by inserting the pivot pin member 28 through the respective holes in the support frame 12 and the frame structure 22. Caps 38 and 40 are then placed on the ends of the pivot pin member 28 to secure it in place. The brace member 56 is then pivotally secured to the frame structure 22 by inserting its end portion 62 into the appropriate hole in the frame structure 22 and by securing it in place with an end cap. The hook member 102 is rotatably connected to the saddle support frame 12 by inserting its end projection 104 into the appropriate hole in the central portion 16 of the frame 12 and the projection is secured in place by an end cap 106.

The clamping and support frame 70 is secured or assembled to the saddle support frame 12 by inserting the wire that forms the clamping and support frame 70 through the eyelet formed by the twisted outer end portion 92 of the connecting bar member 90 and moving outer end portion 92 until it is located in the depression 78. Then plastic tubing 80*a* and 80*b* is slipped over the wire forming the clamping and support frame 70 until the tubing 80*a* and 80*b* is located on each side of the depression 78. The cross bar member 96 is then slipped into the eyelet formed by the twisted end portion 94 of the connecting bar member 90 and the end portions 98 and 100 of the connecting bar member 90 are secured to the inner portions of the respective straight portions 18 and 20 of the saddle support frame 12 and that completes the assembly of the saddle holder 10.

Figure 3:
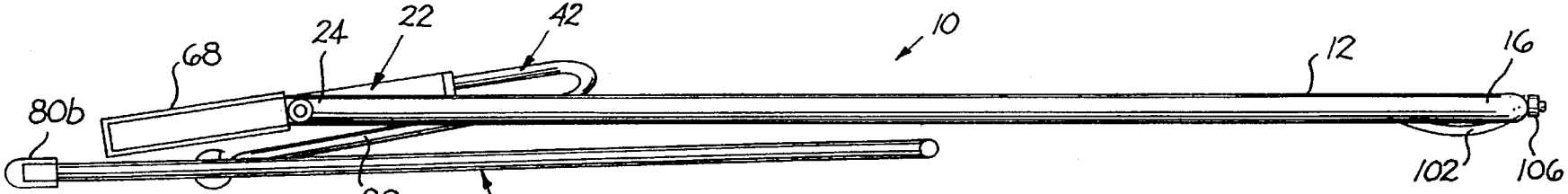
FIG. 3 is a side view of the portable saddle holder set forth in FIGS. 1 and 2, but showing the portable saddle holder in its collapsed or stowed position.
Figure 6:
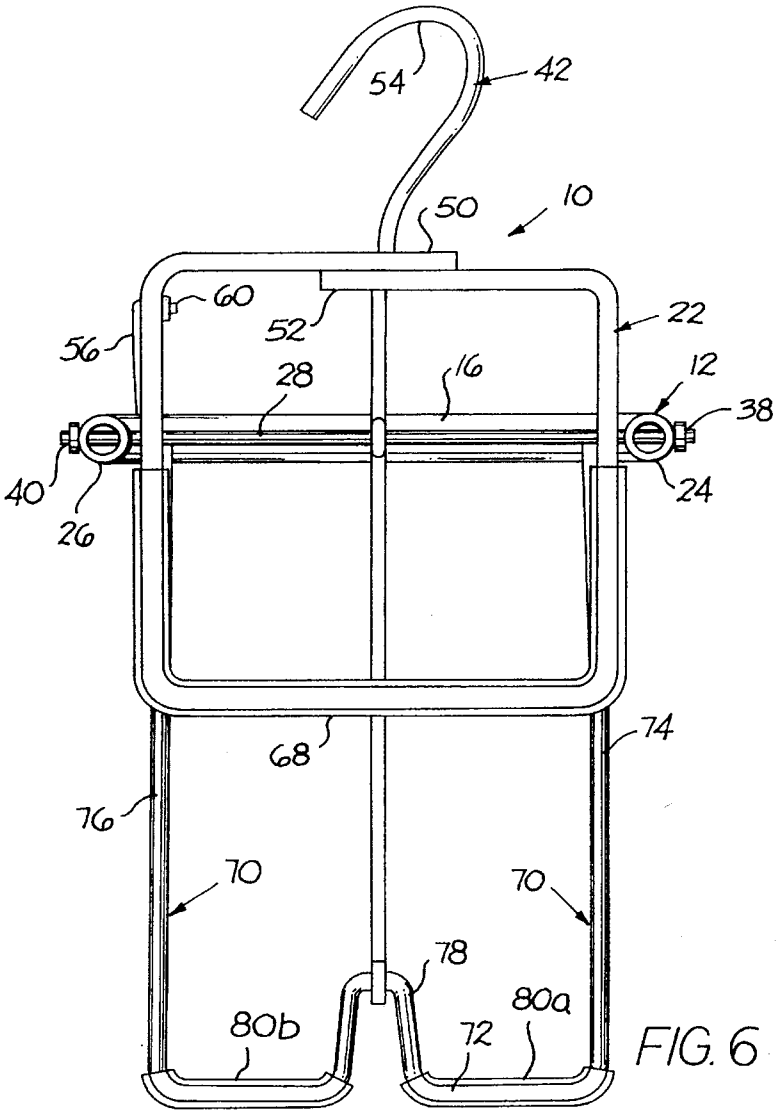
FIG. 6 is an enlarged rear elevational view of the portable saddle holder set forth in FIGS. 1 through 5.
Figure 5:
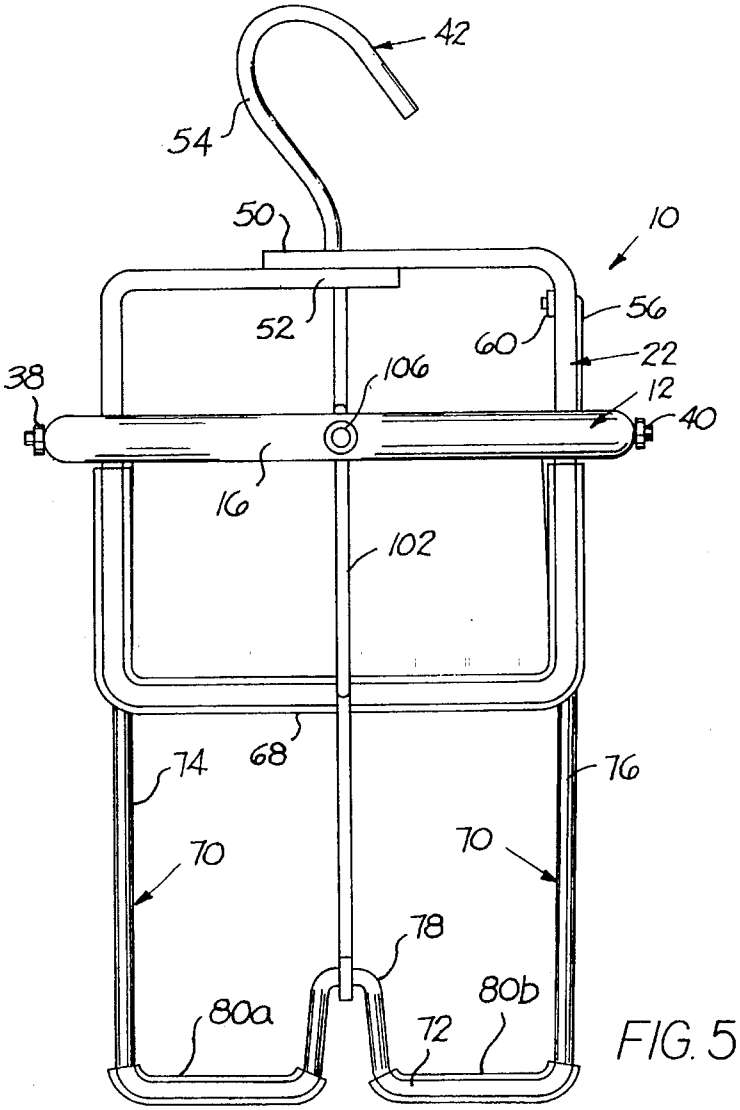
FIG. 5 is an enlarged front elevational view of the portable saddle holder set forth in FIGS. 1 through 4 with the portable saddle holder in its in use position.

The saddle holder 10 is used in the following manner. Generally, the saddle holder 10 would be in its collapsed storage or travel configuration or position as illustrated in FIG. 3. To put the saddle holder 10 in use, the respective projections 82 and 84 located on the ends of the projecting leg portions 74 and 76 would be inserted into one of the respective holes 86*a*, 86*b*, 86*c*, 86*d*, or 86*f* and one of the respective holes 88*a*, 88*b*, 88*c*, 88*d*, or 88*f* in the respective straight portions 18 and 20. In addition, the projecting end portion 62 of the brace member 56 would be inserted into the hole 64 or 66 to secure the frame structure 22 in place.

Figure 7:
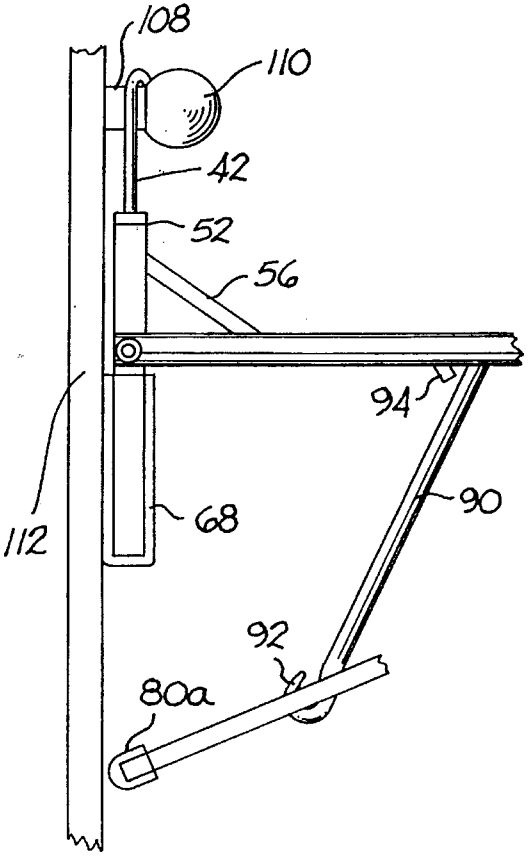
FIG. 7 is a side elevational view of a portion of the saddle holder structure set forth in FIGS. 1 through 6 illustrating one manner in which the saddle holder can be connected to and supported by an external support structure.

The saddle holder 10 can be used with the hook shaped portion 54 of the hook member 42 located around a doorknob shaft 108 of a doorknob 110 as illustrated in FIG. 7 to secure the saddle holder 10 in place against a door 112. When this is done the plastic tubing on the lower portion of the frame structure 22 will bear against the door and prevent marring or damage to its surface. When the hook member 42 is in use the portion of the clamping and support frame 70 would be adjusted until the base portion 72 and associated plastic tubes 80*a* and 80*b* are located so that the tubes 80*a* and 80*b* also bear against the door 112 to allow the clamping and support frame 70 to assist in supporting the saddle support frame 12 and, of course, the associated supported saddle 14.

Figure 9:
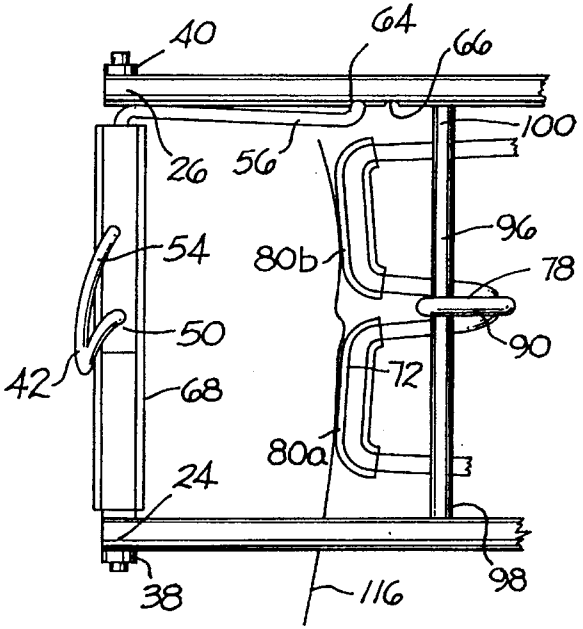
FIG. 9 is a top plan view of the structure set forth in FIG. 8 illustrating how the saddle holder can be connected to and supported by external structures that have various contours.
Figure 8:
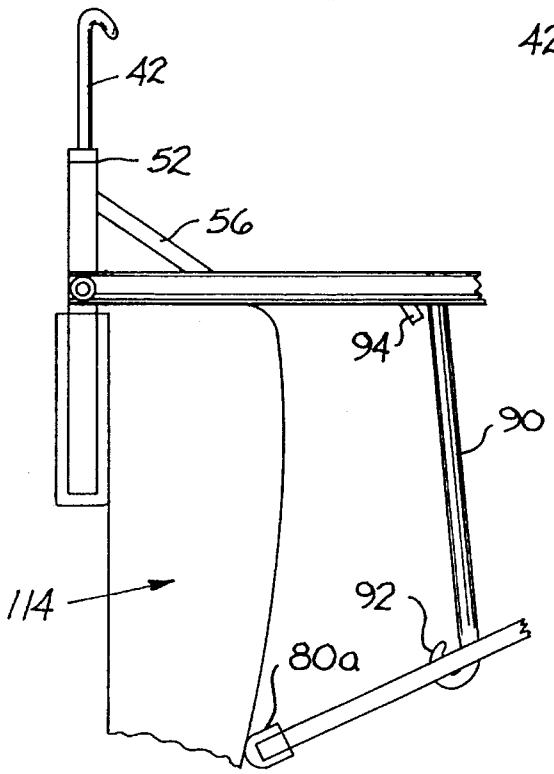
FIG. 8 is a side elevational view of a portion of the saddle holder structure set forth in FIGS. 1 through 7 illustrating another manner in which the saddle holder can be connected to and supported by an external support structure.

The saddle holder 10 can also be used with the lower portion of the frame 22 and the base portion 72 of the clamping and support frame 70 acting as clamping support means to connect and support the saddle holder 10 and associated supported saddle from an appropriate external structure such as a portion of a vehicle 114 as illustrated in FIG. 8. In this case the plastic tubes 80*a* and 80*b* of the base portion 72 would bear against a side of the vehicle structure 114 and the plastic tubing on the lower portion of the frame structure 22 would bear against the other side of the vehicle structure. As illustrated in FIG. 9 due to the construction of the clamping and support frame 70 that permits it to bend and the fact that there is only one connecting member 90 that connects the base portion 72 to the the saddle support frame 12, the base portion 72 and associated plastic tube portions 80*a* and 80*b* can conform to an irregular or varying surface such as that which might be expected on the exterior of the vehicle. In this connection, the single connecting member 90 permits the base portion 72 to pivot around it to a limited extent so that the base portion 72 can conform to an irregular or varying surface such as 116. Consequently, the single connecting member 90 and the flexible or bendable support frame 70 comprise means for permitting the base portion 72 to conform to an irregular or varying surface. The single connecting member 90 also serves as an anti-binding means to prevent binding of the clamping and support frame 70 as it is being moved to its in use position and when it is in use since binding could occur with multiple connecting members. Again, the plastic portions 80*a* and 80*b* prevent damage or marring of the surface of the vehicle when the saddle holder 10 is in use.

Although the invention has been described in considerable detail with reference to a certain preferred embodiment, it will be understood that variations or modifications may be made within the spirit and scope of the invention as defined in the appended claims.

What is claimed is:

1. A portable collapsible saddle holder for supporting a saddle from a structure exterior to the portable collapsible saddle holder comprising a saddle support frame, connecting means operatively connected to said saddle support frame for connecting said saddle holder in a plurality of ways to said structure exterior to said saddle holder, said connecting means including a hook member and adjustable clamping means for connecting said saddle holder to said structure exterior to said saddle holder through a clamping action, said adjustable clamping means having a portion thereof serving to provide support to said saddle support frame when said hook member is connected to said structure exterior to said saddle holder.

2. The portable collapsible saddle holder of claim 1 wherein said adjustable clamping means comprises means for connecting said saddle holder to said structure exterior to said saddle holder having various surface contours or shapes.

3. The portable collapsible saddle holder of claim 2 wherein said means for connecting said saddle holder to said structure having various surface contours or shapes comprises means for connecting said saddle holder to said structure having surfaces with irregular or varying contours as well as uniform surfaces or contours.

4. The portable collapsible saddle holder of claim 3 wherein said adjustable clamping means includes a support frame connected to said saddle support frame and said support frame has a base portion and wherein said means for connecting said saddle holder to said structure having surfaces with irregular or varying contours as well as uniform surfaces or contours comprises a connecting member operatively connected to said saddle support frame and to the base portion of said support frame with the base portion pivoting around said connecting member.

5. The portable collapsible saddle holder of claim 1 wherein said connecting means are pivotally connected to said saddle support frame.

6. The portable collapsible saddle holder of claim 5 wherein said saddle support frame has two end portions and said connecting means includes a frame structure connected to one end portion of said saddle support frame.

7. The portable collapsible saddle holder of claim 6 wherein said frame structure is pivotally connected to said one end portion of said saddle support frame.

8. The portable collapsible saddle holder of claim 7 wherein said hook member is connected to said frame structure.

9. The portable collapsible saddle holder of claim 8 further comprising protecting means for protecting said exterior structure located on at least some portions of said saddle holder intended to contact said exterior structure.

10. The portable collapsible saddle holder of claim 9 further comprising means connected to said saddle support frame for supporting an addition member such as a bridle or the like.

* * * * *